US007048636B1

(12) United States Patent
Sill

(10) Patent No.: US 7,048,636 B1
(45) Date of Patent: May 23, 2006

(54) INSERT APPARATUS FOR A BOWLING BALL, AND METHOD OF USING SAME

(76) Inventor: David A. Sill, 1185 Delta Rd., Walled Lake, MI (US) 48390

( * ) Notice: Subject to any disclaimer, the term of this patent is extended or adjusted under 35 U.S.C. 154(b) by 214 days.

(21) Appl. No.: 10/608,924

(22) Filed: Jun. 27, 2003

(51) Int. Cl.
*A63B 37/00* (2006.01)

(52) U.S. Cl. ..... 473/129; 473/130

(58) Field of Classification Search ..... 473/127, 473/128, 129, 130
See application file for complete search history.

(56) References Cited

U.S. PATENT DOCUMENTS

| | | | | | |
|---|---|---|---|---|---|
| 712,192 | A | * | 10/1902 | Immen | 473/130 |
| 3,102,725 | A | | 9/1963 | Jarus | |
| 4,029,953 | A | * | 6/1977 | Natoli | 362/382 |
| 4,561,654 | A | * | 12/1985 | Haza | 473/129 |
| 4,892,308 | A | | 1/1990 | Gaunt | |
| 5,118,106 | A | * | 6/1992 | Goldman | 473/129 |
| 5,505,666 | A | * | 4/1996 | Arsenault | 473/129 |
| 5,738,592 | A | | 4/1998 | Saunders | |
| 5,795,236 | A | * | 8/1998 | Alberts et al. | 473/129 |
| 5,800,276 | A | | 9/1998 | Hill | |
| 2003/0195051 | A1 | * | 10/2003 | Graskewicz | 473/128 |

OTHER PUBLICATIONS

Advertisement for "GripLoc Bowling Ball Inserts" (no year of publication provided), published for/by GripLoc Products L.L.C. of Sterling Heights, Michigan.

* cited by examiner

*Primary Examiner*—William M. Pierce
(74) *Attorney, Agent, or Firm*—Carrier, Blackman & Associates, P.C.; William D. Blackman; Joseph P. Carrier

(57) ABSTRACT

An insert apparatus for a bowling ball enables a bowler to quickly and easily change thumb and/or finger hole inserts in the ball on-site at a bowling location. The insert apparatus includes a socket member for substantially permanent installation in a bowling ball. The insert apparatus also includes a removable insert member which fits nestingly into the socket member, and which is temporarily and removably lockable therein. The insert member includes a reduced diameter hub at the bottom end thereof, with a plurality of fingers extending outwardly from the hub. The socket member has a central aperture formed in the bottom end thereof to receive the hub of the insert member, and cutouts are formed adjacent the central aperture to receive the fingers of the insert member. Tracks are also provided in the base of the socket member, to guide movement of the fingers in the socket member.

9 Claims, 7 Drawing Sheets

INSERT APPARATUS FOR A BOWLING BALL, AND METHOD OF USING SAME

BACKGROUND OF THE INVENTION

1. Field of the Invention

The present invention relates to a two-part bowling ball insert. More particularly, the present invention relates to a bowling ball insert including a socket member for substantially permanent installation in a bowling ball, and a removable insert member, which fits nestingly and slidably into the socket member, and which is temporarily and removably lockable therein.

2. Description of the Background Art

A number of different bowling ball inserts are known for allowing a user to change part of the insert to accommodate different users or different conditions. In the U.S. patent classification system, class 473, subclass 130 relates to removable inserts and bushings for bowling balls.

Examples of some of the known inserts include those described in U.S. Pat. No., 3,102,725 to Jarus, U.S. Pat. No. 4,892,308 to Gaunt, U.S. Pat. No. 5,118,106 to Goldman, U.S. Pat. No. 5,738,592 to Saunders, and U.S. Pat. No. 5,800,276 to Hill.

Although the known bowling ball inserts have some utility for their intended purposes, a need still exists in the art for an improved insert apparatus for use with a bowling ball, in which an insert member is securely retainable in a socket member in a bowling ball, until such time as a user wishes to remove the insert member.

SUMMARY OF THE INVENTION

The present invention relates to an insert apparatus for a bowling ball, to enable a bowler to quickly and easily change thumb and/or finger hole inserts in the ball during competition, or otherwise on-site at a bowling location. The insert apparatus according to the invention includes a socket member for substantially permanent installation in a bowling ball, and a removable insert member, which fits nestingly into the socket member, and which is temporarily and removably lockable therein.

The socket member includes a cylindrical sleeve having a first hollow bore formed therein with a first diameter, and a base formed integrally with the sleeve, the base including a first locking structure.

The insert member is configured to fit nestingly inside said socket member and includes a substantially cylindrical main body having an upper end and a lower end, and a second locking structure attached to the lower end of the main body and configured to cooperatively interact with the first locking structure.

The insert member is nestingly insertable into the first hollow bore of the socket member and is twistable, when fully inserted therein, to cooperatively interengage the first and second locking structures, and to temporarily and removably lock the insert member in the socket member.

The insert can be removed and exchanged with a different insert by a simple twist of the thumb or finger, to allow a bowler to adjust for a change in thumb or finger size, or to change other characteristics of the insert. Non-limiting examples of insert characteristics which could be customized by changing the insert include pitch, taper, angle, span, bevel, size, or internal texture of the insert.

In a first illustrative embodiment of the invention, the socket member has a particularly configured central aperture formed in the bottom thereof, with a plurality of cutouts radially spaced around the opening and in communication therewith.

Also in the first illustrative embodiment, the insert member includes a substantially cylindrical main body having an upper end and a lower end, and a reduced-diameter hub attached to and extending downwardly from the lower end of the main body. Further in the first embodiment, the insert member also includes a plurality of spaced apart fingers operatively attached to the hub and extending outwardly thereon.

Still further in the first embodiment, the fingers of the insert member are alignable in registry with the cutouts of the socket member adjacent the central aperture thereof. When the insert is fully inserted into the socket member, it may then be twisted until the fingers travel past the cutouts, to temporarily lock the insert in place in the socket member.

In a modified embodiment thereof, the socket member may include an optional circular groove formed in the floor thereof and surrounding the central aperture thereof, to receive an O-ring seal.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
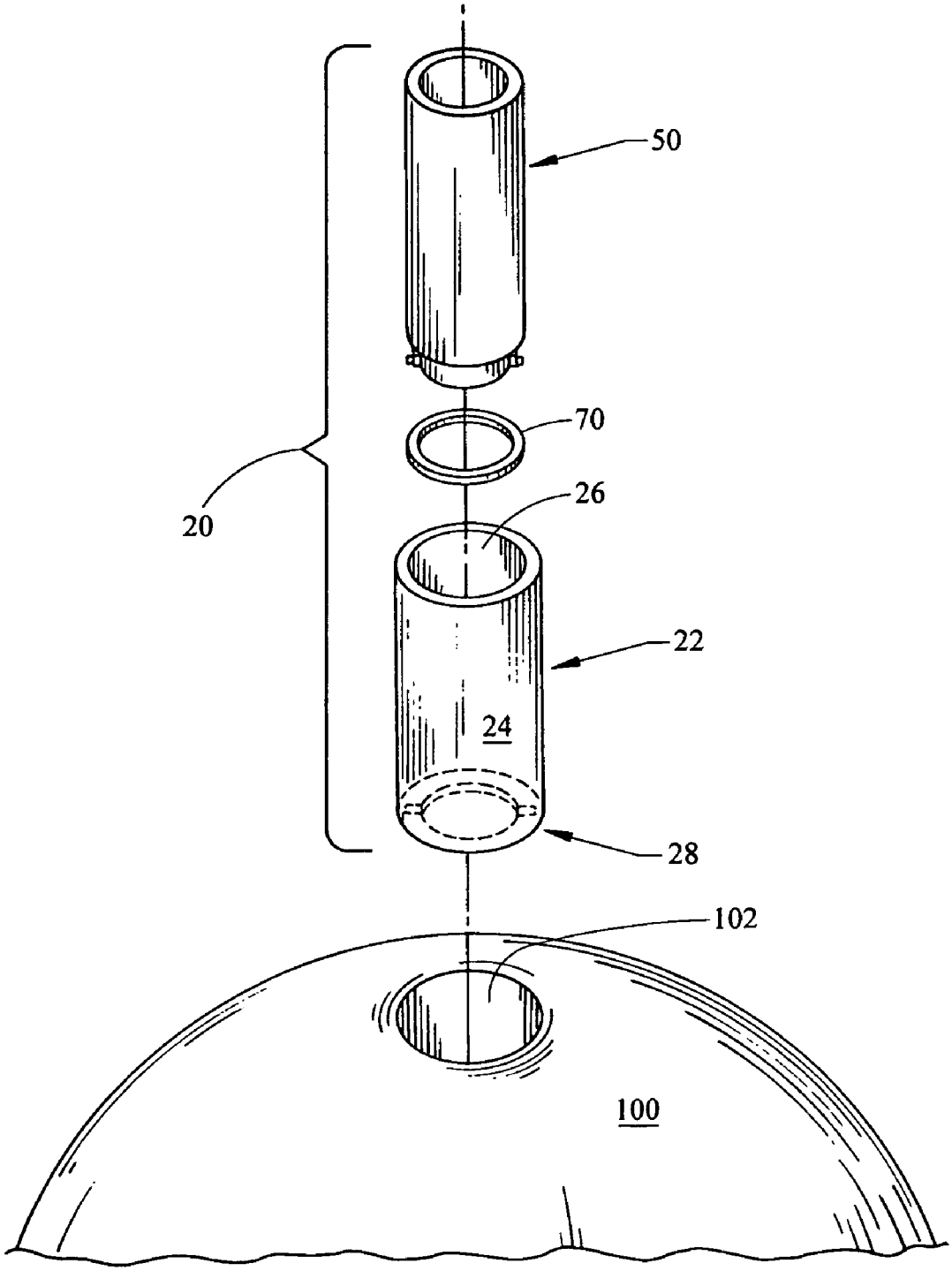
FIG. 1 is an exploded perspective view of a bowling ball and an insert apparatus according to a first illustrative embodiment of the invention.
Figure 2:
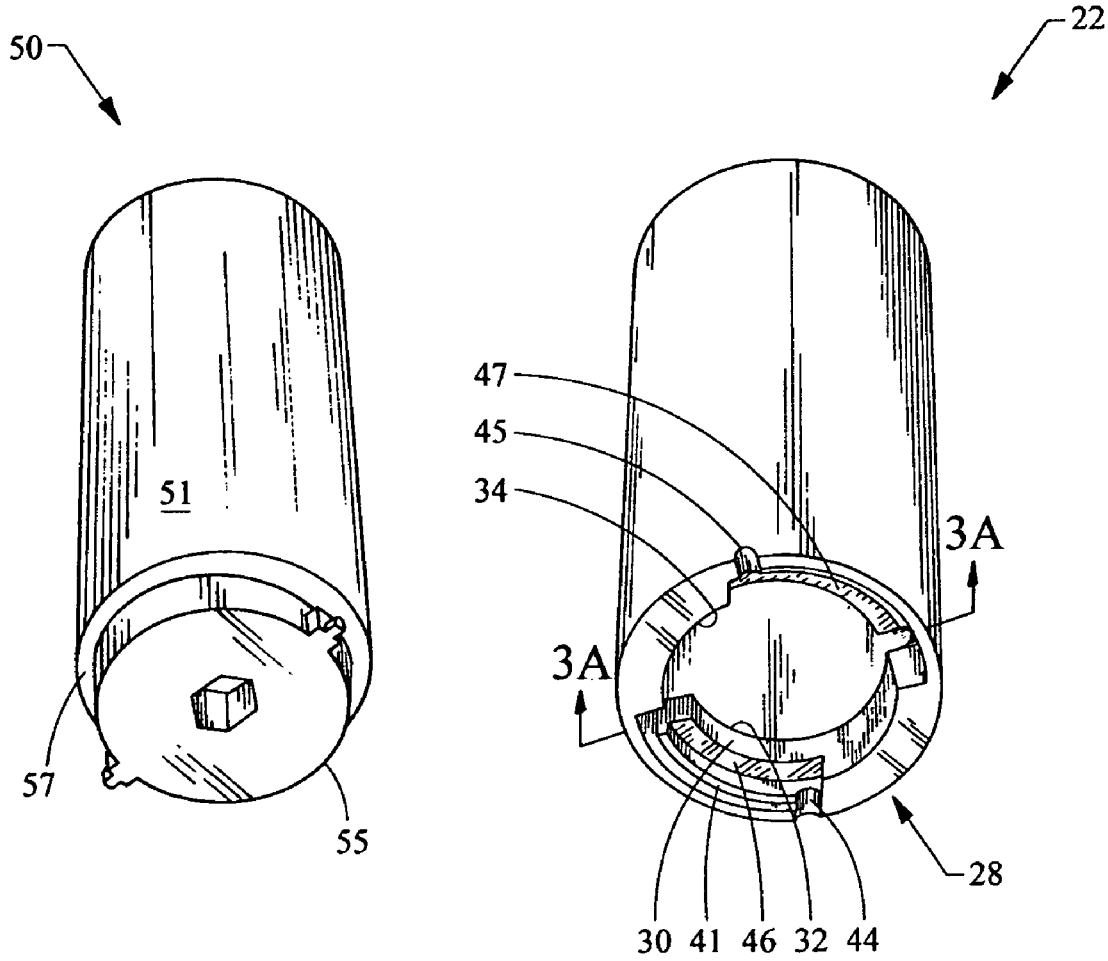
FIG. 2 is a perspective view of the insert apparatus according to the first embodiment, with the components thereof shown separately from a vantage point below the apparatus.
Figure 5:
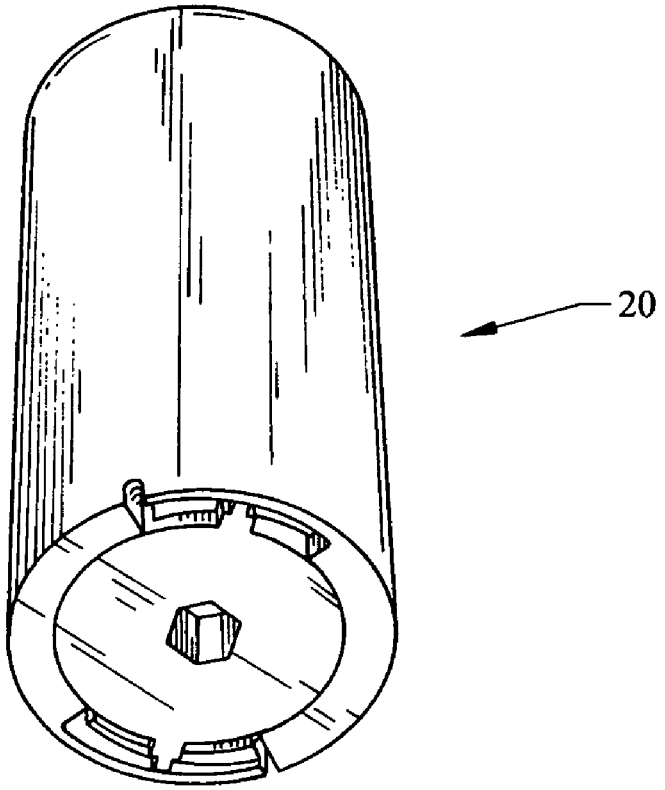
FIG. 5 is a perspective view of the insert apparatus of FIGS. 1–2, from a vantage point below the apparatus with the components thereof shown nested together.

Referring now to FIGS. 1–2 and 5 of the drawings, an insert apparatus according to a first embodiment of the invention is shown generally at 20. In FIG. 1, the apparatus 20 is shown in exploded perspective view, suspended above a bowling ball. Although the insert apparatus 20 is provided for use together with a bowling ball 100, the apparatus 20 according to the present invention does not include a bowling ball, per se. The bowling ball 100 is shown for purposes of illustration, and to show the environment in which the apparatus 20 is used.

Throughout the present specification, relative positional terms like 'upper', 'lower', 'front', 'rear', 'top', 'bottom', 'horizontal', 'vertical', and the like are used to refer to the orientation of the apparatus 20 as shown in FIG. 1 of the drawings, which is the operative orientation of the apparatus during gripping of the bowling ball 100 by a user. These relative positional terms are used in an illustrative sense to describe the depicted embodiments, and are not meant to be limitative. It will be understood that the depicted apparatus may be placed at an orientation different from that shown in the drawings, such as inverted 180 degrees or transverse to that shown, and in such a case, the above-identified relative positional terms will no longer be accurate.

Overview

An insert apparatus 20 according to the embodiment of FIGS. 1–2 includes a socket member 22 and an insert member 50, which fits nestingly inside of the socket member. The insert member is temporarily and removably lockable in the socket member.

The socket member 22 is provided for substantially permanent installation in a hollowed-out hole 102 formed in a bowling ball 100. The hole 102 in the bowling ball is made in a size to closely conform to the exterior of the socket member 22. Both the insert member and socket member are made from high-strength plastic material.

The Socket Member

The socket member 22 includes a cylindrical sleeve 24 having a hollow cylindrical bore 26 formed therein. When used for a thumb hole, the insert sleeve may be made in a size between one and a half and two inches outside diameter. The hollow bore 26 has an inside diameter D (FIG. 3A) of a predetermined size.

Optionally, the cylindrical bore 26 can be tapered by 1–5 degrees, to be slightly larger at the top than at the bottom thereof, in order to facilitate entry and exit of the insert member therein.

The socket member 22 also includes a base 28 which is integrally formed with the sleeve 24. The base 28 includes a floor panel 30 extending inwardly at the bottom of the sleeve 24, and defining a ledge 32.

The floor panel 30 has a circular aperture 34 formed centrally therein, which is coaxial with the sleeve 24, and which has a diameter smaller than the diameter D of the central bore 26. The floor panel 30 also has a plurality of cutouts 36, 38 (FIG. 3B) formed therein in communication with the central aperture 34.

As seen best in FIGS. 3A–3B, the base 28 of the socket member 22 also has a pair of channels 40, 42 formed therein below the floor panel 30, with one channel adjacent each of the cutouts 36, 38, respectively. Each of the channels 40, 42 defines a respective track 41, 43 in the base 28 below the floor panel 30.

Figure 3A:
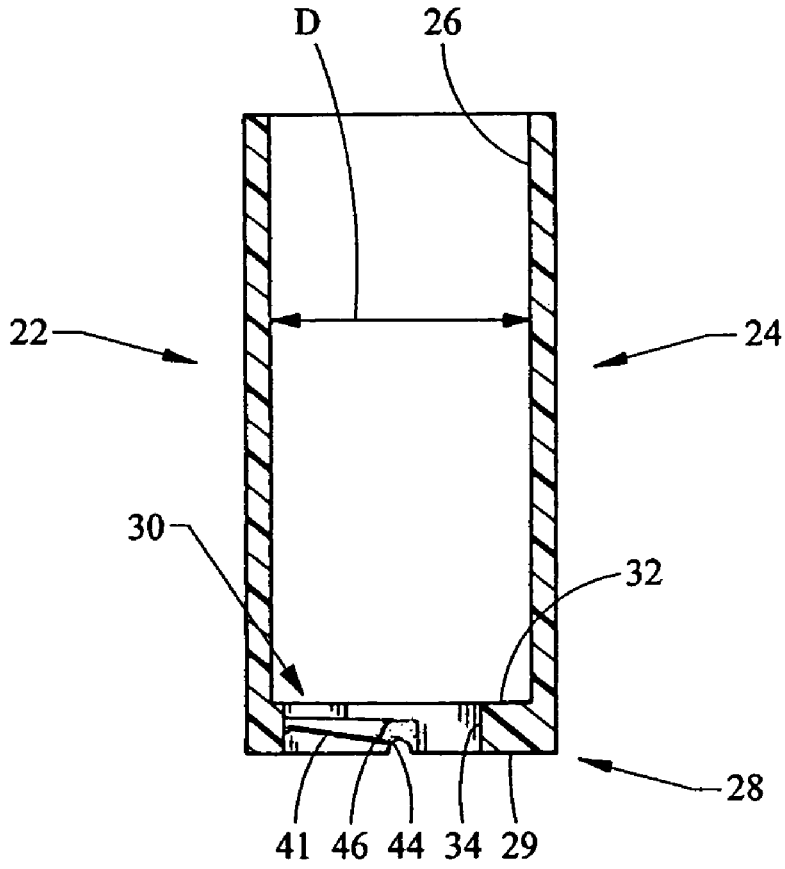
FIG. 3A is a cross-sectional view of a socket member which is one component of the apparatus of FIGS. 1–2.
Figure 3B:
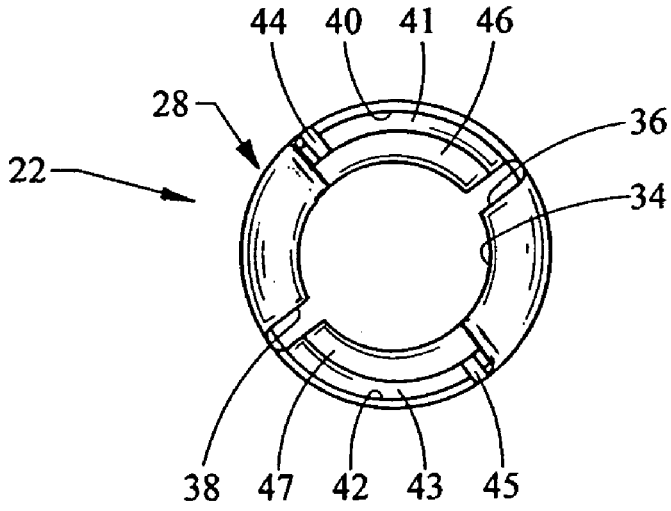
FIG. 3B is a bottom plan view of the socket member of FIG. 3A.
Figure 4A:
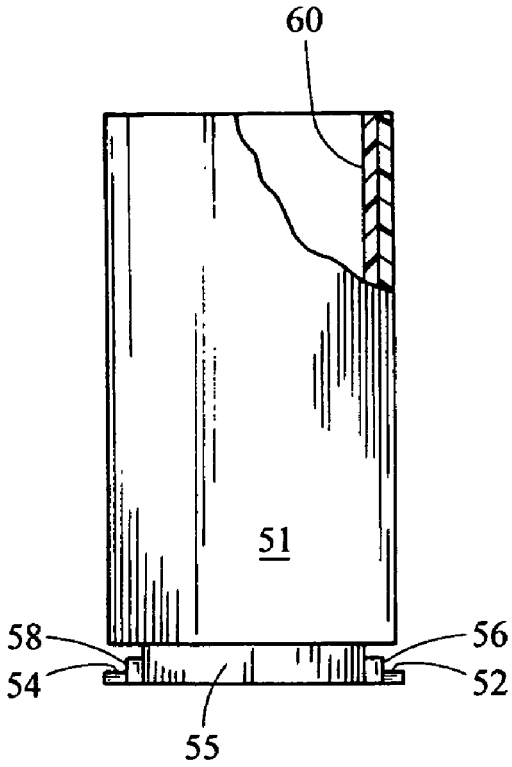
FIG. 4A is a side elevational view of an insert member which is another component of the insert apparatus of FIGS. 1–2, partially shown cut away and in cross-section.

In the first depicted embodiment, and as seen in FIGS. 2 and 3A, the tracks 41, 43 are formed as ramps, and have respective notches 44, 45 formed therein at ends thereof opposite the cutouts, to temporarily retain the fingers 52, 54 of the insert member 50 therein (FIG. 4A). It will therefore be understood that the tracks 41, 43 are elevated above the bottom surface 29 of the base 28.

Another feature of the first embodiment is that the channels 40, 42 also define flat, upwardly recessed guideways 46, 47 elevated above the lower surface of the base 28. The guideways 46, 47 are provided to guide movement of a pair of projections 56, 58 which extend outwardly at the bottom of the insert 22, and which support the fingers 52, 54 thereon. Where used, the guideways 46, 47 are disposed at a different level from the tracks 41, 43, so that viewed together, the guideways and tracks resemble inverted stair steps, as shown.

The Insert Member

The insert member 50 is configured to fit nestingly inside of the socket member 22. The insert member 50 may be pre-drilled in a specified size, to form a hollow opening therein.

Alternatively, the insert member 50 may be made as a substantially solid member, so that it may be custom drilled after purchase, in a size chosen to fit a thumb or finger of a user (not shown).

The optional ability to custom-drill the hole in the insert member 50 allows a user to add additional components to the insert, such as other, commercially available bowling ball inserts, inside of the insert member 50 hereof.

As noted, the insert member 50 is made from a high-strength plastic material. Optionally, the insert member may be made from a dual durometer material, with the main body 51 and hub 55 made from a strong, rigid material and a second, more resilient material provided as a liner 60 inside of the main body, to promote grippability in use. Where used, the liner 60 may be made from an elastomeric material, and is integrally bonded to the main body 51, so as to be substantially inseparable therefrom.

In the embodiment of FIGS. 1–2, the insert member 50 includes a substantially cylindrical main body 51 having an upper end and a lower end, and a reduced-diameter hub 55 attached to and extending downwardly from the lower end of the main body. Optionally, the main body 51 may be slightly tapered, to match a tapered bore of the sleeve. The lower end of the insert member 50 includes a flattened annular surface 57 surrounding the hub 55.

When the insert member 50 is installed in the socket member 22, the annular surface 57 rests on the ledge 32 of the socket member.

The apparatus 20 hereof may be made so that the insert member 50 can be installed into, and removed from the socket member 22 without requiring any tools.

Alternatively, the insert member 50 may have a geometric opening formed in the end thereof to receive a tool, such as the hexagonal opening shown in FIG. 2, which would receive an Allen wrench (not shown) to facilitate installation and removal of the insert member.

Optionally, the apparatus hereof may also include one or more thin washers, such as that shown at 70, for use as the apparatus gets used over time and becomes worn, to maintain a good friction fit between the socket member 22 and the insert member 50. Where used, the washer 70 fits between the annular surface 57 and the ledge 32.

In the depicted embodiment of FIGS. 1–2, the insert member 50 also includes a pair of projections 56, 58 which extend outwardly from the bottom of the insert 22, and plurality of spaced apart fingers, such as those shown at 52 and 54, operatively attached to the hub 55 and extending outwardly from the projections. The projections 56, 58 cooperate with the guideways 46, 47 and may be substantially rectangularly box-shaped, as shown. The projections are used to provide strength to the insert member 50 since in use, the insert member 50 is effectively supporting the weight of the ball 100 thereon.

Figure 4B:
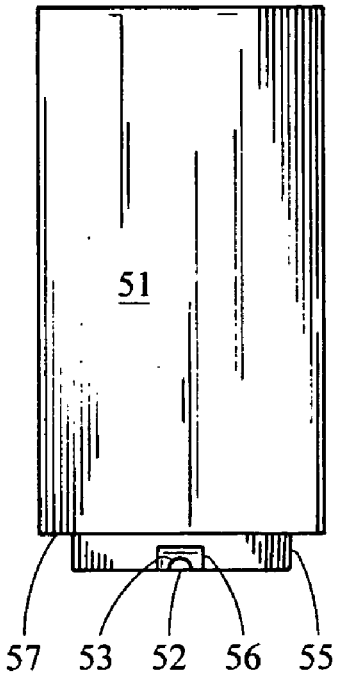
FIG. 4B is a front elevational view of the insert member of FIG. 4A.
Figure 4C:
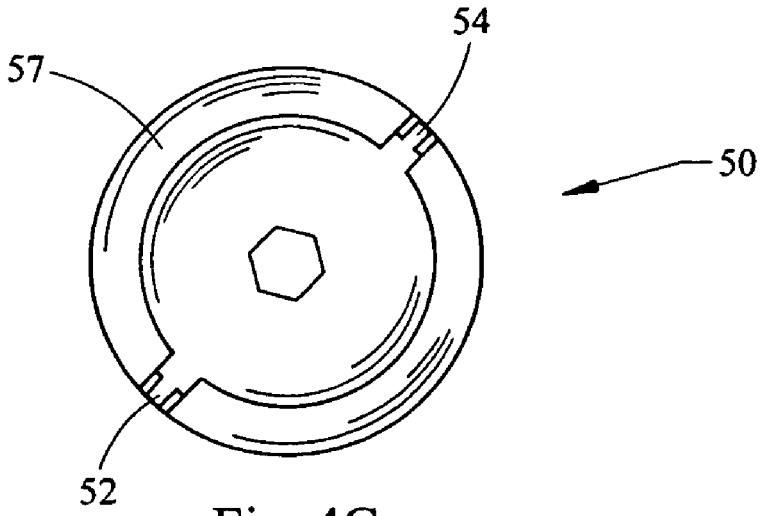
FIG. 4C is a bottom plan view of the insert member of FIGS. 4A–4B.

The portions of the fingers 52, 54 which contact the tracks 41, 43 have curved lower surfaces, as shown. The upper edge 53 of the finger 52 can be seen can to be rounded in FIG. 4B, and this rounded upper edge 53 contacts a track 41 of the socket member 22. The rounded upper edge 53 of the finger 52 also fits into a notch 44 at the end of the track 41, to temporarily and disengagably lock the insert member 50 in the socket member.

Second Embodiment

Referring now to FIGS. 6A, 6B, 7A and 7B, an insert apparatus according to a second illustrative embodiment includes a socket member 122 and an insert member 150, which fits nestingly inside of the socket member. The insert member 150 is temporarily and removably lockable in the socket member 122.

As in the first embodiment, the socket member 122 is provided for substantially permanent installation in a hollowed-out hole 102 formed in a bowling ball 100.

The Socket Member

The socket member 122 includes a cylindrical sleeve 124 having a hollow cylindrical bore 126 formed therein. The hollow bore 126 has a diameter of a predetermined size. The socket member 122 also includes a base 128 which is integrally formed with the sleeve 124. The base 128 includes a floor panel 130 extending inwardly at the bottom of the sleeve 124, and defining a ledge 132.

The floor panel 130 has a circular aperture 134 formed centrally therein, which is coaxial with the sleeve 124, and which has a diameter smaller than the diameter of the central bore 126. The floor panel 130 also has a plurality of cutouts 136, 137, 138, 139 (FIG. 6B) formed therein in communication with the central aperture 34.

Figure 6A:
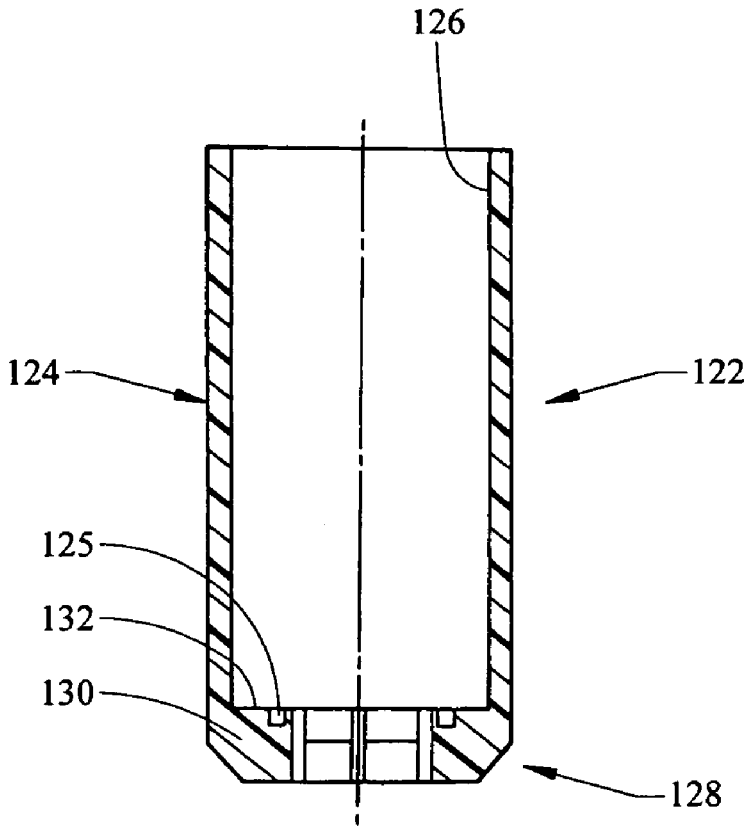
FIG. 6A is a cross-sectional view of a socket member according to a second embodiment of the invention.
Figure 6B:
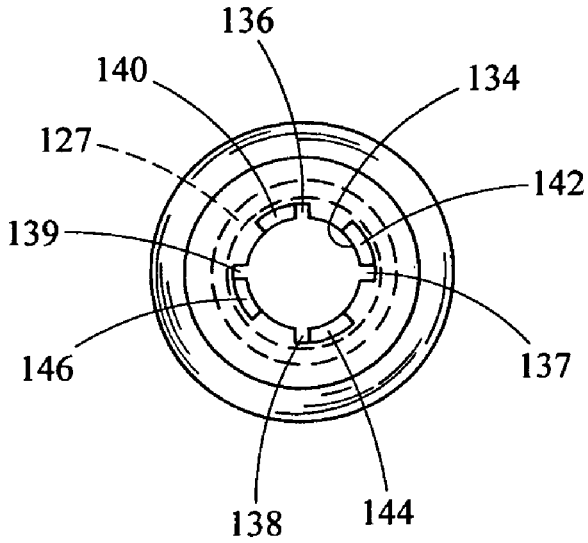
FIG. 6B is a bottom plan view of the socket member of FIG. 6A.
Figure 7A:
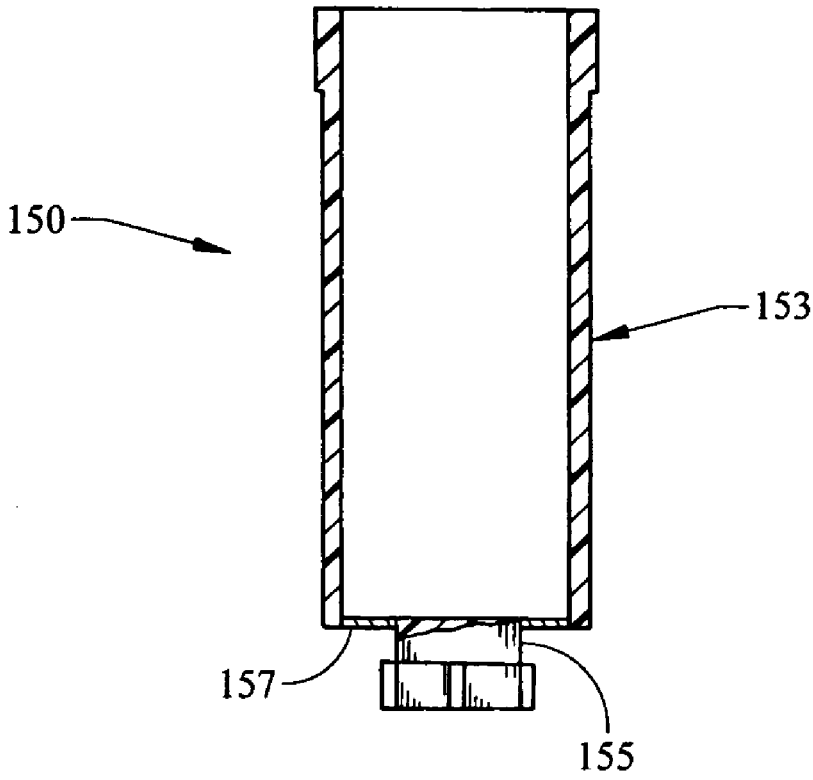
FIG. 7A is cross-sectional view of an insert member according to the second embodiment of the invention.
Figure 7B:
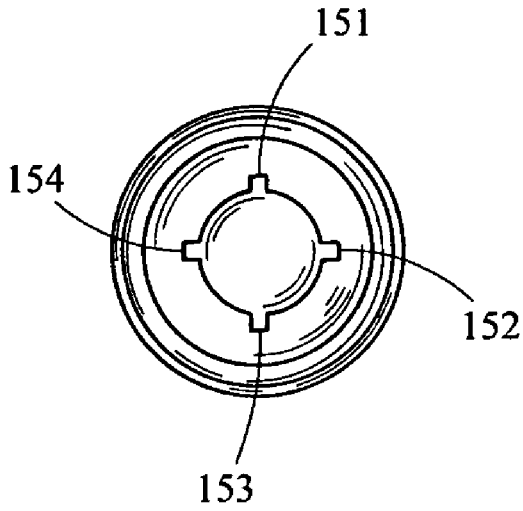
FIG. 7B is a bottom plan view of the insert member of FIG. 7A.

As seen best in FIG. 6B, the base 128 of the socket member 122 also has a plurality of channels 140, 142, 144, 146 formed therein below the floor panel 130, with one channel adjacent each of the cutouts 136, 137, 138, 139 respectively. Each of the channels 140, 142, 144, 146 defines a respective track in the base 128 below the floor panel 130. In the second embodiment, and as seen in FIG. 6B, the channels 140, 142, 144, 146 have respective notches formed therein at ends thereof opposite the cutouts, to temporarily retain the fingers 151, 152, 153, 154 of the insert member 150 therein. It will therefore be understood that the tracks defined by the channels 142, 144, 146, 148 are elevated above the bottom surface of the base 128.

Another feature of the second embodiment is that the floor panel 130 of the socket member 122 has an annular groove 125 formed therein to receive an O-ring seal 127. Where used, this O-ring seal 127 provides a friction fit between the insert 150 and the floor panel, and helps to temporarily and removably fix the position of the insert member 150 inside of the socket member 122.

The Insert Member

The insert member 150 is configured to fit nestingly inside of the socket member 122. The insert member 150 may be pre-drilled in a specified size, to form a hollow opening therein.

Alternatively, the insert member 150 may be made as a substantially solid member, so that it may be custom drilled after purchase, in a size chosen to fit a thumb or finger of a user (not shown).

The insert member 150 includes a substantially cylindrical main body 153 having an upper end and a lower end, and a reduced-diameter hub 155 attached to and extending downwardly from the lower end of the main body. The lower end of the insert member 150 includes a flattened annular surface 157 surrounding the hub 155.

When the insert member is installed in the socket member, the annular surface 157 rests on the ledge 132 of the socket member 122.

The insert member 150 also includes a plurality of spaced apart fingers, such as those shown at 151, 152, 153 and 154, operatively attached to the hub 155 and extending outwardly therefrom.

Method of Using

The present invention also encompasses a method of using the described insert apparatus.

One embodiment of a method of using the insert apparatus includes a first step of gluing a socket member in a hole formed in a bowling ball, the socket member comprising a cylindrical sleeve having a first hollow bore formed therein with a first diameter, and a base formed integrally with the sleeve, the base comprising a first locking structure;

Another step in the inventive method involves inserting an insert member into the hollow bore of the socket member, the insert member comprising a substantially cylindrical main body having an upper end and a lower end, and a second locking structure attached to the lower end of the main body and configured to cooperatively interact with the first locking structure;

Still another step in the inventive method involves aligning the first locking structure with the second locking structure; and Yet another step in the inventive method involves twisting the insert member in the socket member, to engage the first and second locking structures and to temporarily and removably lock the insert member in the socket member.

Although the present invention has been described herein with respect to a preferred embodiment thereof, the foregoing description is intended to be illustrative, and not restrictive. Those skilled in the art will realize that many modifications of the preferred embodiment could be made which would be operable. For example, one modification of the invention could be that the first locking structure shown and described for the socket member, could instead be provided on the insert member and in that case, the corresponding second locking structure would be located on the socket member. All such modifications which are within the scope of the claims are intended to be within the scope and spirit of the present invention.

What is claimed is:

1. An insert apparatus for use with a bowling ball, said apparatus comprising a socket member and an insert member which fits removably into the socket member, said socket member having an upper end and a lower end and comprising a cylindrical sleeve having a first hollow bore formed therein with a first diameter and a base formed integrally with the sleeve, the base comprising a first locking structure, said first locking structure comprising:

a ridge extending inwardly at the lower end of the socket member and having a plurality of cutouts formed therein for receiving fingers of the insert member, and a plurality of tracks formed in the base of the socket member adjacent said cutouts, respectively each of said tracks comprising a ramp for guiding movement of one of said fingers thereon, the ramps becoming thicker with increasing angular distance from the cutouts, each of said tracks further having a radially extending notch formed in an end thereof to engagingly receive one of said fingers, whereby the notches are capable of lockingly and disengagably receiving said fingers therein;

said insert member configured to fit nestingly inside said socket member and comprising a substantially cylindrical main body having an upper end and a lower end, and a second locking structure attached to the lower end of said main body and configured to cooperatively interact with said first locking structure, said second locking structure comprising a plurality of fingers extending radially outwardly on a lower end of the insert member and spaced to fit into the cutouts in the base of the socket member;

wherein said insert member is nestingly insertable into said first hollow bore of said socket member and is twistable in said socket member, when fully inserted therein, to engage said first and second locking structures to temporarily and removably lock the insert member in the socket member.

2. The insert apparatus of claim 1, wherein the main body of the insert member is formed from a substantially rigid material, and wherein the insert member further comprises a liner inside of the main body.

3. The insert apparatus of claim 2 wherein the insert member is made from dual materials, with the main body and hub made from a strong, rigid plastic material and the liner formed from a second, more resilient material.

4. The insert apparatus of claim 3 wherein the liner comprises an elastomeric material.

5. An insert apparatus for use with a bowling ball, said apparatus comprising a socket member and an insert member which fits removably into the socket member, said socket member comprising a cylindrical sleeve having a first hollow bore formed therein with a first diameter and a base formed integrally with the sleeve, the base comprising a floor panel extending inwardly at the bottom of the sleeve and defining a ledge, said floor panel having a second hollow bore formed centrally therein which is coaxial with the sleeve and which has a second diameter smaller than the first diameter, said floor panel having a plurality of cutouts formed radially therein in communication with said second bore, said base having a channel formed in said floor panel corresponding to each of said cutouts, respectively, and extending away from each said cutout, each of said channels defining a track formed in said base below said ledge, said insert member configured to fit nestingly inside said socket member and comprising a substantially cylindrical main body having an upper end and a lower end, and a reduced-diameter hub attached to and extending downwardly from the lower end of the main body, said insert member further comprising a plurality of spaced apart fingers operatively attached to said hub and extending radially outwardly thereon;

wherein said insert member is nestingly insertable into said first hollow bore of said socket member with the fingers aligned with the respective cutouts in the base of said socket member, and said insert member is twistable in said socket member, when fully inserted therein, to slide said fingers along said tracks.

6. The insert apparatus of claim 5 wherein said tracks comprise ramps, the ramps extending downwardly with increasing angular distance from the cutouts.

7. The insert apparatus of claim 5 wherein said tracks of said socket member have notches formed therein at ends thereof opposite said cutouts, to temporarily retain the fingers therein.

8. An insert apparatus for use with a bowling ball, said apparatus comprising a socket member and an insert member which fits removably into the socket member, said socket member comprising a cylindrical sleeve having a first hollow bore formed therein with a first diameter and a base formed integrally with the sleeve, the base comprising a floor panel extending inwardly at the bottom of the sleeve and defining a ledge, said floor panel having a second hollow bore formed centrally therein which is coaxial with the sleeve and which has a second diameter smaller than the first diameter, said floor panel having a plurality of cutouts formed therein extending through portions of said ledge and in communication with said second bore, said base having a channel formed therein below said floor panel corresponding to each of said cutouts, respectively, and extending away from each said cutout, each of said channels defining a track formed in said base below said ledge, said tracks having notches formed therein at ends thereof opposite the cutouts, to temporarily retain the fingers therein, wherein said tracks comprise ramps which extend downwardly with increasing angular distance from the cutouts;

said insert member configured to fit nestingly inside said socket member and comprising a substantially cylindrical main body having an upper end and a lower end, and a reduced-diameter hub attached to and extending downwardly from the lower end of the main body, said insert member further comprising a plurality of spaced apart fingers integrally attached to said hub and extending outwardly thereon;

wherein said insert member is nestingly insertable into said first hollow bore of said socket member with the fingers aligned with the respective cutouts in the base of said socket member, and said insert member is twistable in said socket member, when fully inserted therein, to slide said fingers along said tracks, and wherein said fingers are temporarily and disengagably lockable in said notches.

9. A method of using an insert apparatus, comprising the steps of:

a) gluing a socket member in a hole formed in a bowling ball, said socket member comprising a cylindrical sleeve having a first hollow bore formed therein with a first diameter, and a base formed integrally with the sleeve, the base comprising a first locking structure wherein the first locking structure comprises a plurality of cutouts formed in the base of the socket member to receive a corresponding plurality of fingers of an insert member therein, and a plurality of tracks formed in the base of the socket member adjacent said cutouts, respectively, each of said tracks having a notch formed at an end thereof to engagingly receive one of said fingers;

b) inserting an insert member into the hollow bore of said socket member, said insert member comprising a substantially cylindrical main body having an upper end and a lower end, and a second locking structure attached to the lower end of said main body and configured to cooperatively interact with said first locking structure, wherein said second locking structure comprises a plurality of fingers extending outwardly on the lower end of the insert member, c) aligning said first locking structure with said second locking structure; and d) twisting said insert member in said socket member, to engage said first and second locking structures and to temporarily and removably lock the insert member in the socket member.

* * * * *